US010710860B2

(12) United States Patent
Warren et al.

(10) Patent No.: US 10,710,860 B2
(45) Date of Patent: Jul. 14, 2020

(54) CLOSURE REMOVAL APPARATUS AND METHOD

(71) Applicant: Behr Process Corporation, Santa Ana, CA (US)

(72) Inventors: Gregory James Warren, Costa Mesa, CA (US); Robert L. Vance, Santa Ana, CA (US); Anthony Gmitruk, Laguna Niguel, CA (US); Jose L. Vega, Whittier, CA (US)

(73) Assignee: BEHR PROCESS CORPORATION, Santa Ana, CA (US)

( * ) Notice: Subject to any disclaimer, the term of this patent is extended or adjusted under 35 U.S.C. 154(b) by 538 days.

(21) Appl. No.: 15/150,524

(22) Filed: May 10, 2016

(65) Prior Publication Data

US 2016/0332857 A1 Nov. 17, 2016

Related U.S. Application Data

(60) Provisional application No. 62/161,959, filed on May 15, 2015.

(51) Int. Cl.
*B67B 7/15* (2006.01)
*B67B 7/14* (2006.01)

(52) U.S. Cl.
CPC . *B67B 7/15* (2013.01); *B67B 7/14* (2013.01)

(58) Field of Classification Search
CPC .... B67B 7/14; B67B 7/15; B67B 7/16; B67B 7/066
USPC ..... 53/492; 81/3.27, 3.29, 3.37; 29/221.6
See application file for complete search history.

(56) References Cited

U.S. PATENT DOCUMENTS 1,240,657 A * 9/1917 Bolick ..... B67B 7/16 81/3.27
1,726,465 A 8/1929 Bird
2,335,777 A 11/1943 Marcellus
2,407,428 A * 9/1946 Kretchman ..... B67B 7/14 29/214
2,633,041 A 3/1953 Aue et al.
4,631,769 A 12/1986 White
4,649,615 A * 3/1987 Hundley ..... B25B 27/023 29/261
4,750,391 A * 6/1988 Sweatt ..... B67B 7/066 81/3.29
5,000,063 A * 3/1991 Federighi, Sr. ..... B67B 7/066 81/3.37

(Continued)

FOREIGN PATENT DOCUMENTS

CN 201343430 Y 11/2009
CN 201530709 U 7/2010

(Continued)

*Primary Examiner* — Andrew M Tecco
*Assistant Examiner* — Nicholas E Igbowke
(74) *Attorney, Agent, or Firm* — Reising Ethington P.C.

(57) ABSTRACT

A method of removing a closure from a container includes engaging three or more pry fingers against a lid and a container of the package in three or more locations spaced circumferentially around the package, and moving the pry fingers against the container and the lid, to pry the lid away from the container. A closure remover includes a frame, an actuator movable with respect to the frame, and a plurality of kinematic links movably carried between the frame and the actuator and including a plurality of articulatable pry fingers.

21 Claims, 9 Drawing Sheets

(56) References Cited

U.S. PATENT DOCUMENTS

| | | | | | |
|---|---|---|---|---|---|
| 5,159,743 | A * | 11/1992 | Somerville | B25B 27/026 | 29/252 |
| 5,233,740 | A * | 8/1993 | Chen | B25B 27/026 | 29/252 |
| 6,139,253 | A * | 10/2000 | Battrel | B01D 25/26 | 414/796.9 |
| 7,134,362 | B1 * | 11/2006 | March | B67B 7/18 | 81/3.4 |
| 8,061,238 | B2 * | 11/2011 | Cink | B25B 13/48 | 81/3.29 |
| 2004/0011160 | A1 * | 1/2004 | Crowley | B67B 7/14 | 81/3.55 |
| 2008/0196228 | A1 * | 8/2008 | Angel | B25B 27/02 | 29/221.6 |
| 2011/0259152 | A1 | 10/2011 | Kovacs | | |

FOREIGN PATENT DOCUMENTS

| | | | |
|---|---|---|---|
| CN | 203095569 | U | 7/2013 |
| DE | 2020006011187 | U1 | 11/2006 |
| JP | 05178395 | A | 7/1993 |

* cited by examiner

CLOSURE REMOVAL APPARATUS AND METHOD

TECHNICAL FIELD

This disclosure relates generally to tools and, more particularly, to receptacle closure removers and related methods.

BACKGROUND

Packages, for example, paint packages, can be somewhat difficult to open. Current approaches include use of a prying device, like a key or a screwdriver, to break a seal between a lid and a container of a package, one pry spot at a time, circumferentially around the package. This process is time-consuming and can damage the lid.

SUMMARY OF THE DISCLOSURE

One illustrative embodiment of a closure remover includes a frame, an actuator movable with respect to the frame, and a plurality of kinematic links movably carried between the frame and the actuator and including a plurality of articulatable pry fingers.

In accordance with another illustrative embodiment, there is provided a method of removing a closure from a container that includes engaging at least three pry fingers against a lid and a container of the package in at least three locations spaced circumferentially around the package, and moving the pry fingers against the container and the lid, to pry the lid away from the container.

DETAILED DESCRIPTION

In general, a disclosed novel closure removal method and apparatus provide a fast and efficient way to remove closures from containers to open packages, while maintaining package integrity. The method and apparatus will be described using an illustrative embodiment of a paint package including a paint can and a corresponding lid. However, it will be appreciated as the description proceeds that the method and apparatus may be useful in many different applications and may be implemented in many other embodiments. Also, as used herein, it will be understood that the term "paint" refers not only to paint applications, but also to stain, varnish, and other applications. In other words, as used herein, the term "paint" broadly includes paint, stain, varnish, and any other similar products.

Figure 1:
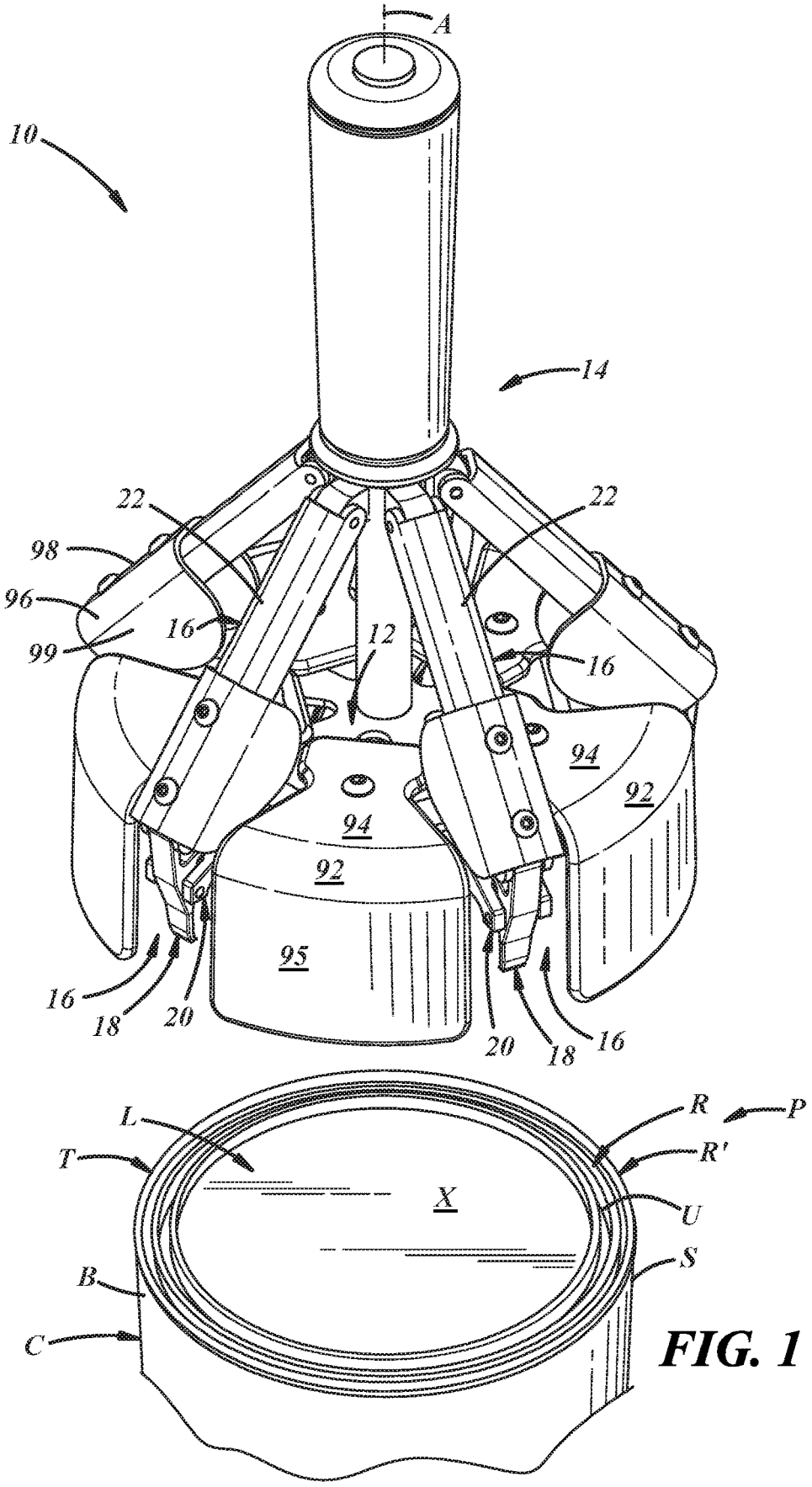
FIG. 1 is a perspective view according to an illustrative embodiment of a closure remover configured to remove a lid from a container of a package, and illustrating the closure remover oriented over the package.

Referring specifically to the drawings, FIG. 1 shows an illustrative embodiment of a closure remover 10 that may be used to remove a lid L from a container C of a package P. The lid L may include a central portion X that may be planar, and an annular lid rim R disposed radially outwardly of the central portion X and including a U-shaped channel U. The container C may include a body portion B having a closed bottom end (not shown), an open top end T, a radially outer surface S, and an annular container rim R' at the open top end T and including a U-shaped channel U' (FIG. 4) for coupling to the corresponding U-shaped channel U of the lid L.

In general, the closure remover 10 includes a base or frame 12, an actuator 14 movable with respect to the frame 12, for example, along a central longitudinal axis A, and a plurality of kinematic links 16 that are movably coupled between the frame 12 and the actuator 14 and that include a plurality of articulatable pry fingers 18. The pry fingers 18 may engage corresponding portions of the container C and the lid L to pry the lid L off of the container C when the actuator 14 is actuated. The kinematic links 16 also may include a plurality of guide links 20 movably carried by the frame 12, and a plurality of drive links 22 movably coupled to the actuator 14. The pry fingers 18 are movably coupled to the guide links 20 and movably coupled to the drive links 22. The quantity of kinematic links 16 may be at least three, five as illustrated, or any other suitable quantity.

Figure 2:
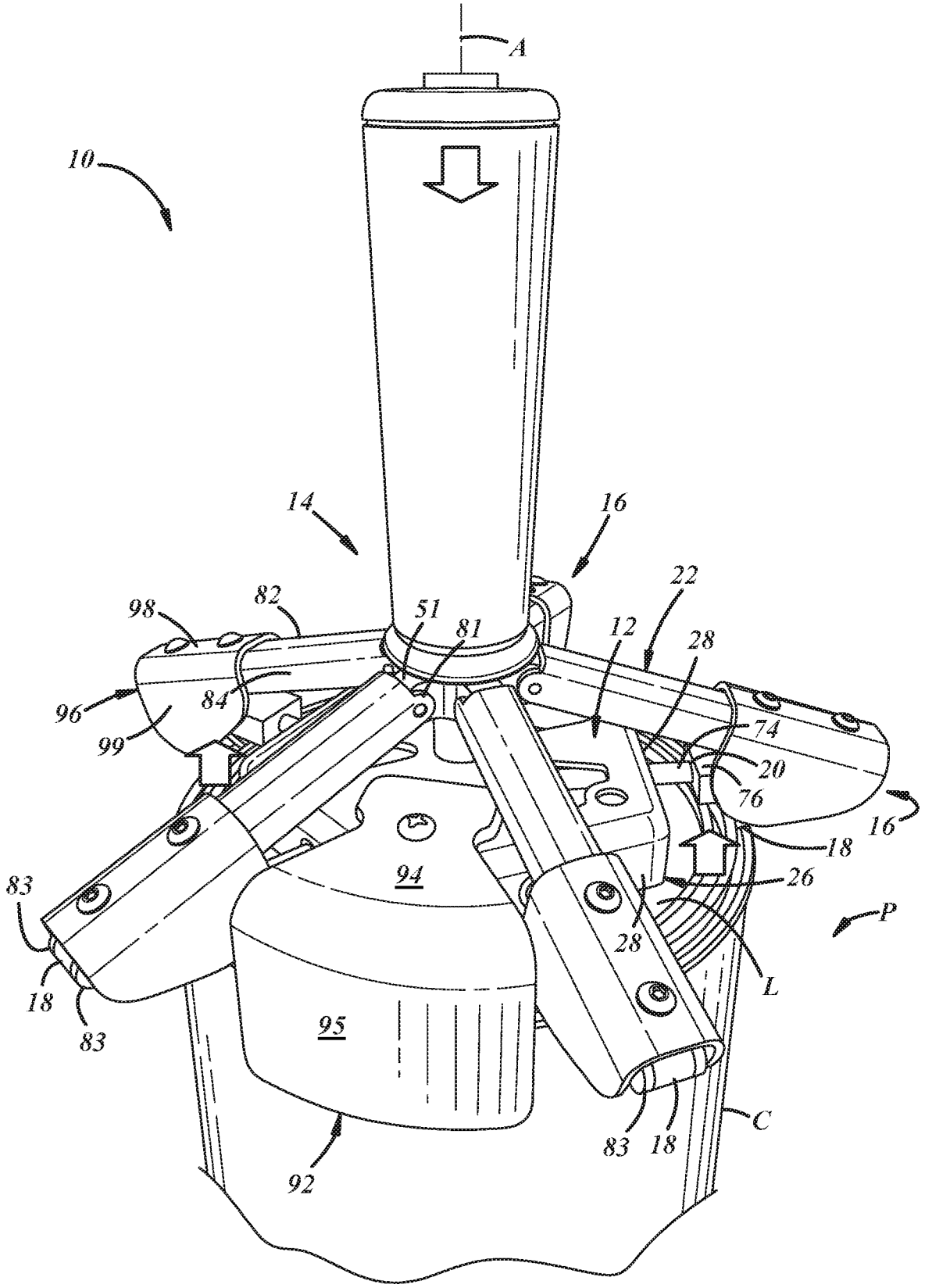
FIG. 2 is a perspective view of the closure remover and package of FIG. 1, and illustrating the closure remover operatively engaged with the package to remove the lid from the container.

With reference to FIG. 2, the closure remover 10 is operatively engaged with the package P such that the actuator 14 may move along the central longitudinal axis A of the closure remover 10 when the closure remover 10 is removing the lid L from the container C.

Figure 3:
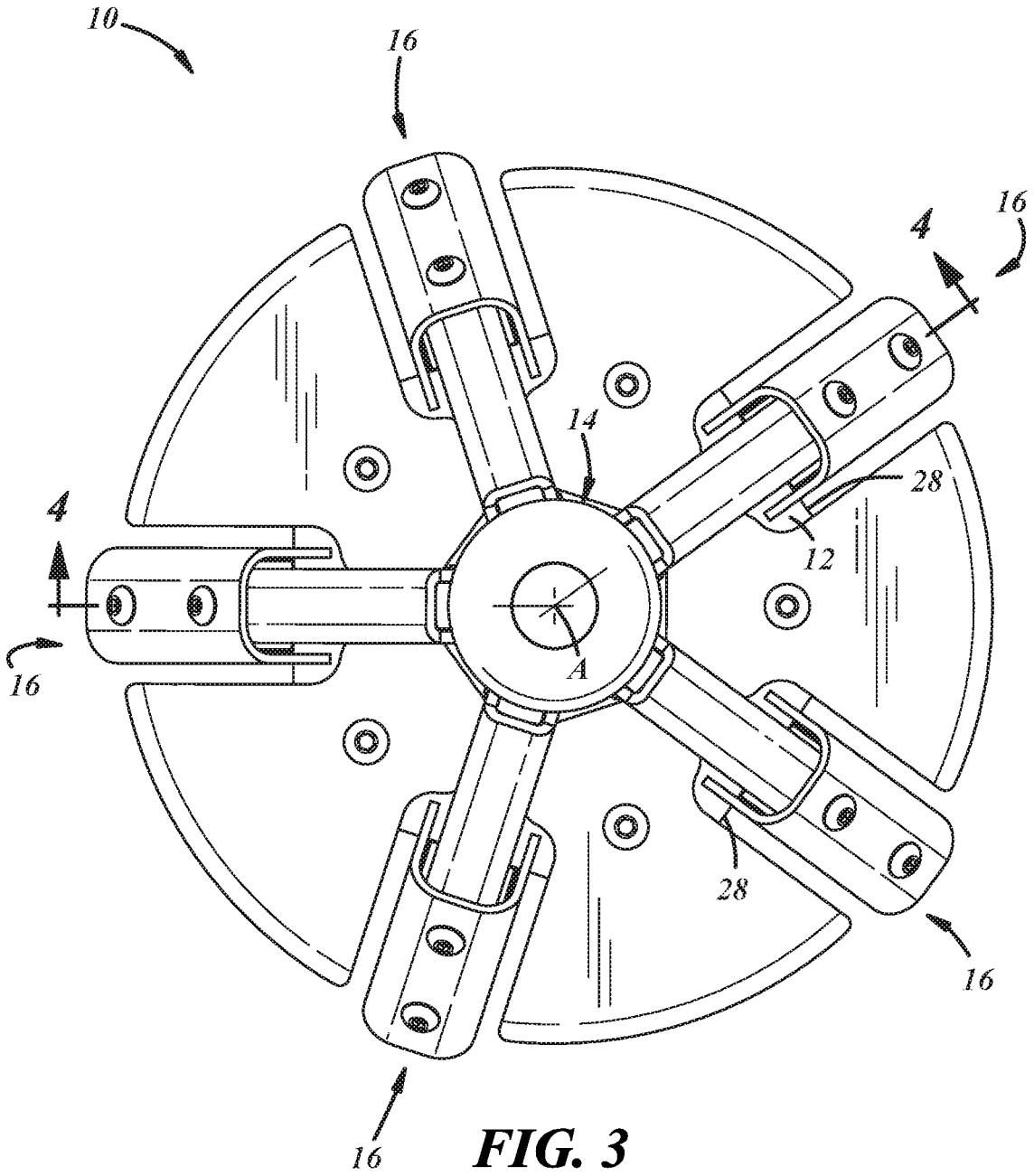
FIG. 3 is a top view of the closure remover of FIG. 1.

With reference to FIG. 3, the closure remover 10 is shown from the top thereof. The kinematic links 16 may be equidistantly circumferentially spaced about the axis A.

Figure 4:
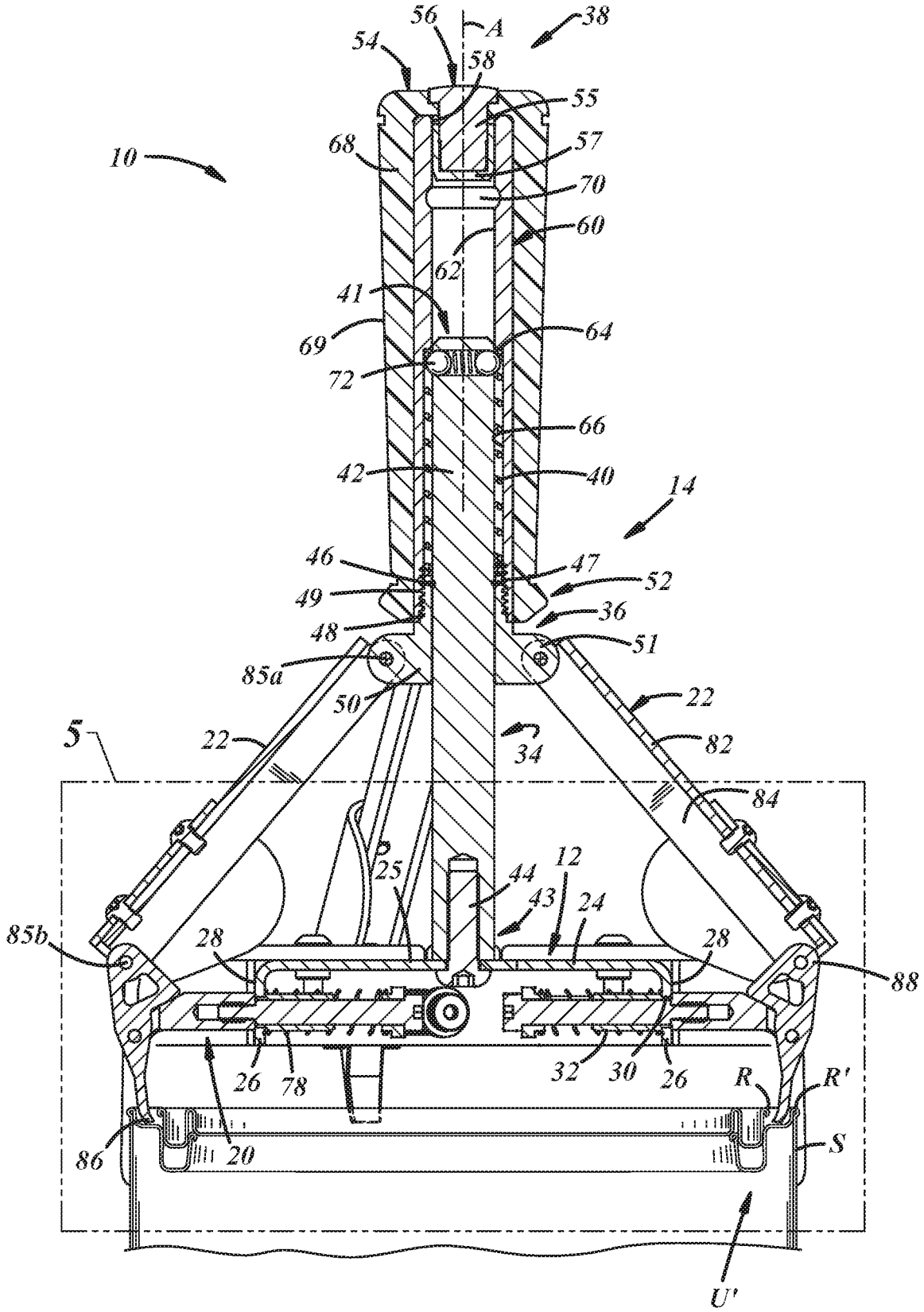
FIG. 4 is a cross-sectional view of the closure remover of FIG. 1, taken along line 4-4 of FIG. 3, and illustrating the closure remover initially engaged with the package.
Figure 5:
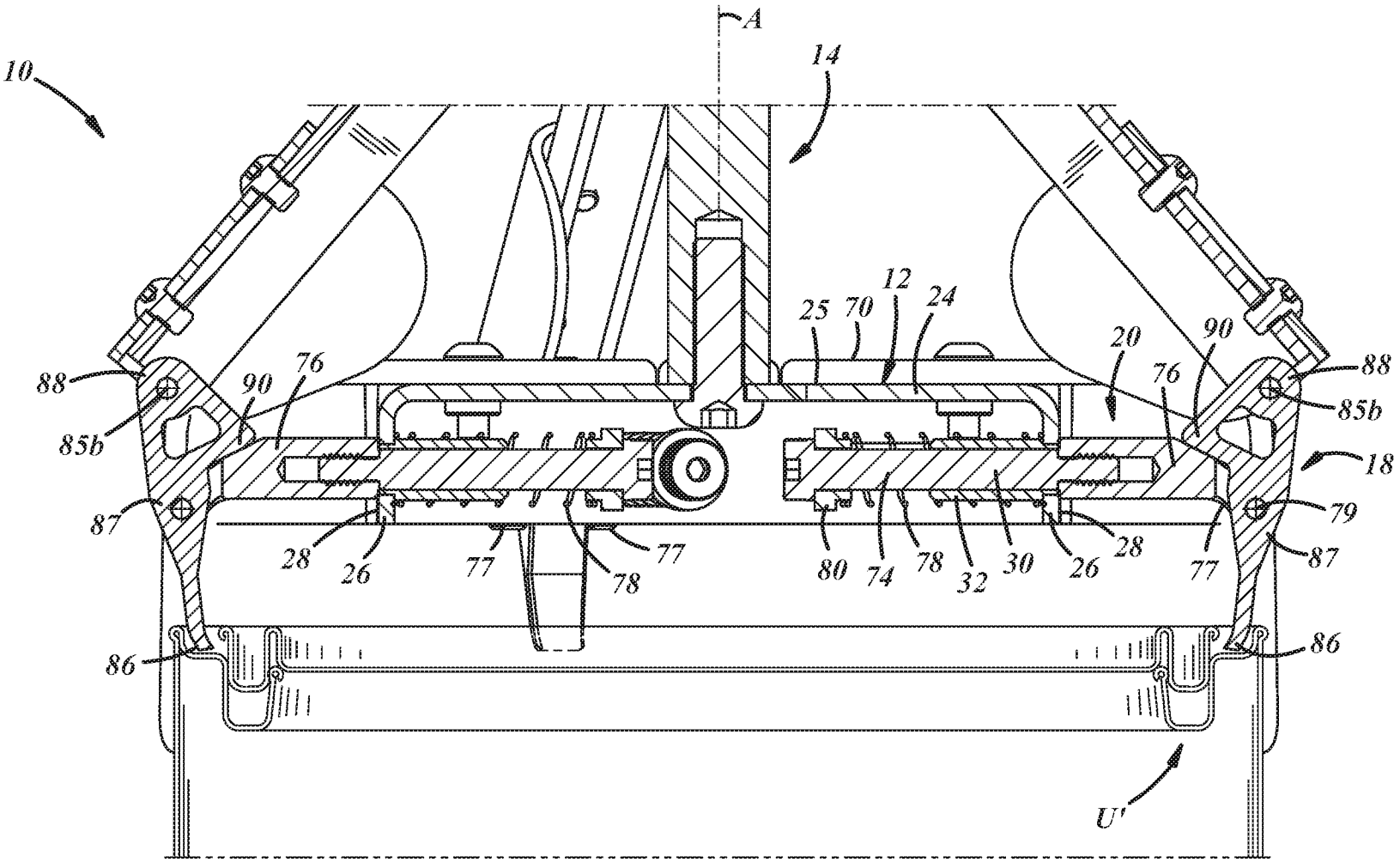
FIG. 5 is an enlarged, fragmentary view of the closure remover of FIG. 1, taken from rectangle 5 of FIG. 4.

With reference to FIGS. 4 and 5, the frame 12 may include a base wall 24 that may extend predominantly in a direction transverse with respect to the central longitudinal axis A of the closure remover 10. Also, the frame 12 may include a peripheral skirt 26 that may extend away from the base 24, for example, in a predominantly axial direction. The base 24 may include an upper surface 25 to receive or engage a portion of the actuator 14. The skirt 26 may include a plurality of facets 28 and a plurality of passages 30 extending through the skirt 26, for instance, in radial directions. The passages 30 may be equidistantly spaced about the circumference of the skirt 26. The quantity of passages 30 may be at least three, five as illustrated, or any other suitable quantity. In this embodiment, the frame 12 also includes passage extensions 32 coaxial with the passages 30. The passage extensions 32 may be integral portions of the frame 12 or may be separate components coupled to the frame 12 by, for example, fastening, welding, staking, and/or in any other suitable manner. The frame 12 may be composed of metal, for instance, black anodized 5052-H32 aluminum for the base 24 and skirt 26, and black anodized 6061 aluminum for the extensions 32.

With reference to FIG. 4, the actuator 14 may include an actuator guide 34 that may be carried by the frame 12 and may extend in a direction away from the frame 12 and along the central longitudinal axis A of the closure remover 10, a link collar or coupling 36 that may be translatably carried by the guide 34, a handle 38 that may be translatably carried by the guide 34, and a spring 40 that may be operatively disposed between the handle 38 and the guide 34.

The guide 34 may include a shaft 42 that may be cylindrical, with a free end 41 and an oppositely disposed fixed end 43 that may be threaded for coupling to the base wall 24 of the frame 12, for example, via a fastener 44. In other embodiments, the guide 34 may be coupled to the frame 12 by direct threading thereto, welding, press fit, integral threading, staking, or any other suitable coupling configuration. The shaft 42 may be composed of metal, for instance, 4140 steel.

Additionally, the spring 40 may be carried by the shaft 42 of the guide 34 and, as illustrated, may include a coiled compression spring carried around a portion of the shaft 42. The spring 40 may be axially located to the shaft 42 by a portion of the shaft 42, for instance, a shoulder of the shaft 42 or a snap ring 46 coupled to the shaft 42 and via an intermediate washer 47 carried by the snap ring 46. In other embodiments, the spring 40 may include an elastomeric or viscous disc, puck, cylinder, and/or any other suitable means by which the handle 38 may be biased in a direction away from the frame 12.

Also, the link coupling 36 may include a hollow shaft or hub portion 48 for translatable support on the actuator guide 34, and a spoke or knuckle portion 50 extending from the hub portion 48. The hub portion 48 may have an upper end that is threaded 49, and the knuckle portion may have a plurality of circumferentially spaced bosses or knuckles 51 for pivotable coupling to the drive links 22.

Further, the handle 38 may include a fixed end 52 that may be coupled to the link coupling 36. As illustrated, the handle 38 may be axially adjustably coupled to the link coupling 36, for example, via a threaded connection including the handle threads and the corresponding threads of the link coupling 36, or by any other suitable axially adjustable coupling. In other embodiments, the handle 38 may be coupled to the link coupling 36 by welding, staking, press fit, interlocking elements, and/or any other suitable coupling features. The handle 38 also may include a free end 54 including a detent release button 56 carried in a passage 58 thereof. The detent release button 56 may include a body 55 and a cup-shaped guide 57 to receive the body 55 under an interference fit for translatable engagement within the passage 58 of the handle 38. The detent release button body 55 may be configured to protrude from adjacent or surrounding portions of the handle 38 in an actuated position of the closure remover 10. The handle 38 may include a relatively hard and rigid sleeve 60 that may carry the threads at the fixed end 52, and that may have an internal guide bearing surface 62 on which a portion of the guide 34 rides, an internal spring shoulder 64 for locating a portion of the spring 40, and an internal spring pocket 66 larger in diameter than surface 62 to accommodate the spring 40 between the handle 38 and the guide 34. The sleeve 60 may be composed of metal, for instance zinc coated 4140 steel. The handle 38 also may include a grip 68 that may be relatively soft and compliant and carried externally of the sleeve 60. The grip 68 may be composed of a polymeric material, for instance, a cast polyurethane of 80 durometer on the Shore A scale. In any case, the handle 38 may have an exterior surface 69 of inverted conical shape to resist slipping out of a user's hand.

The actuator 14 also may include a releasable detent that is disposed between the guide 34 and the handle 38, and that includes a fixed portion 70 and a yieldable portion 72. The detent fixed portion 70 may include, for example, a relief in an internal surface of the sleeve 60 of the handle 38. The detent yieldable portion 72 may include, for example, one or more spring loaded balls or other elements carried in a transversely extending passage at the free end 41 of the shaft 42 of the guide 34, as in the illustrated embodiment. Of course, the releasable detent may include other configurations including a yieldable portion integrated into the shaft 42, a fixed portion integrated or coupled to the shaft 42 and a corresponding yieldable portion integrated or coupled to the handle 38, or any other configurations suitable to yieldably hold the handle 38 in an actuated position with respect to the guide 34.

With reference to FIGS. 2 and 5, the guide links 20 may include shafts 74 for translatable movement through the corresponding passages 30 and passage extensions 32 (FIG. 5) of the skirt 26 of the frame 12, and knuckles 76 for pivotable connection to the pry fingers 18. With reference to FIG. 5, the knuckles 76 may include forks with tines 77 spaced apart to accept corresponding portions of the pry fingers therebetween. The knuckles 76 may have holes extending therethrough in a direction transverse with respect to the prevailing longitude of the shafts 74 and corresponding to a pry finger pivot axis 79. The shafts 74 may be threaded or otherwise suitably coupled to the knuckles 76. The guide links 20 may be biased in a radially inward direction.

For example, with reference to FIG. 5, the closure remover 10 also may include springs 78 disposed between the guide links 20 and the frame 12. More specifically, the springs 78 may be disposed between heads of guide link shafts 74 and inside surfaces of corresponding portions of the frame skirt 26. The springs 78 may circumscribe the passage extensions 32. In addition, spring retaining collars 80 may be carried between the heads of the shafts 74 and the springs 78.

With reference to FIG. 2, the drive links 22 may include bases 82 and spaced apart flanges 84 extending away from the bases 82, and oppositely disposed ends or knuckles 81, 83 for pivotable connection to the link coupling knuckles 51 at first ends and for pivotable connection to the pry fingers 18 at opposite second ends. The knuckles 81, 83 may include rounded end portions of the flanges 84 to accept corresponding portions of the coupling knuckles 51 and pry fingers 18 therebetween. The knuckles 81, 83 may have holes extending therethrough in a direction transverse with respect to the prevailing longitude of the links 22 and corresponding to first and second drive link pivot axes 85*a,b* (FIG. 4). The drive links 22 may be composed of metal, for example, black anodized 6061-T6 aluminum.

With reference to FIG. 5, the pry fingers 18 have free ends 86 for engagement with the package P. The free ends 86 may be inwardly and downwardly turned and may be squared with acute angles at radially innermost portions thereof for good prying functionality. Also, the pry fingers 18 have fixed portions 88 oppositely disposed from the free ends 86 to couple to the drive links 22 about the second drive link pivot axis 85*b*, and intermediate portions 87 therebetween to couple to the guide links 20 about the pry finger pivot axis. The intermediate portions 87 and the fixed portions 88 may include holes therein to accept coupling pins, shafts, and/or the like at the pivot axis 85*b*. Further, the pry fingers 18 may include shoulders 90 to locate against corresponding portions of the guide link knuckles 76. In a rest position of the closure remover 10 shown in FIG. 5, the shoulders 90 may be located radially inward of the pivot axes 79 of the pry fingers 18 and axially between the pry finger pivot axes 79 and the second drive link pivot axes 85*b*. The pry fingers 18 may be composed of metal, for instance, clear anodized 6061-T6 aluminum.

Additionally, with reference to FIG. 1, the closure remover 10 may include package locators 92 that may be carried by the frame, and that may include base portions 94 that may extend transversely and may be coupled to the base of the frame and also may include skirt portions 95 that extend axially longer than the pry fingers 18 such that the skirt portions 95 extend prevailingly axially away from the base portions 94 and terminate in free ends axially beyond the pry fingers 18. The locators 92 may be coupled to the frame 12 by fasteners, as illustrated, by staking, adhering, and/or in any other suitable manner. The locators 92 may be composed of plastic, for instance, ABS.

Likewise, the closure remover 10 also may include guards 96 that may be carried by the drive links 22, and that may include base portions 98 that may be coupled to the bases 82 of the drive links 22 and flanges 99 that extend away from the base portions 98 and beyond the flanges 84 of the drive links 22. The guards 96 may be coupled to the drive links 22 by fasteners, as illustrated, or by staking, adhering, or in any other suitable manner. The guards 96 may be composed of metal, for instance, black anodized 5052 aluminum.

In operation, and with reference to FIG. 1, the closure remover 10 may be lowered over and toward the package P. The closure remover 10 may be continued to be lowered so that the package locators 92 pilot the closure remover 10 over and around the package P, before the pry fingers 18 engage the package P (as shown in FIG. 5). Notably, the locators 92 engage the package P merely to facilitate location of the pry fingers 18 with corresponding portions of the package P and do not grasp the outer surface S of the package P to facilitate removal of the lid L. At this point, as shown in FIG. 5, the pry fingers 18 are located between the lid rim R and the container rim R' with the closure remover 10 illustrated in a home or rest position.

Figure 6:
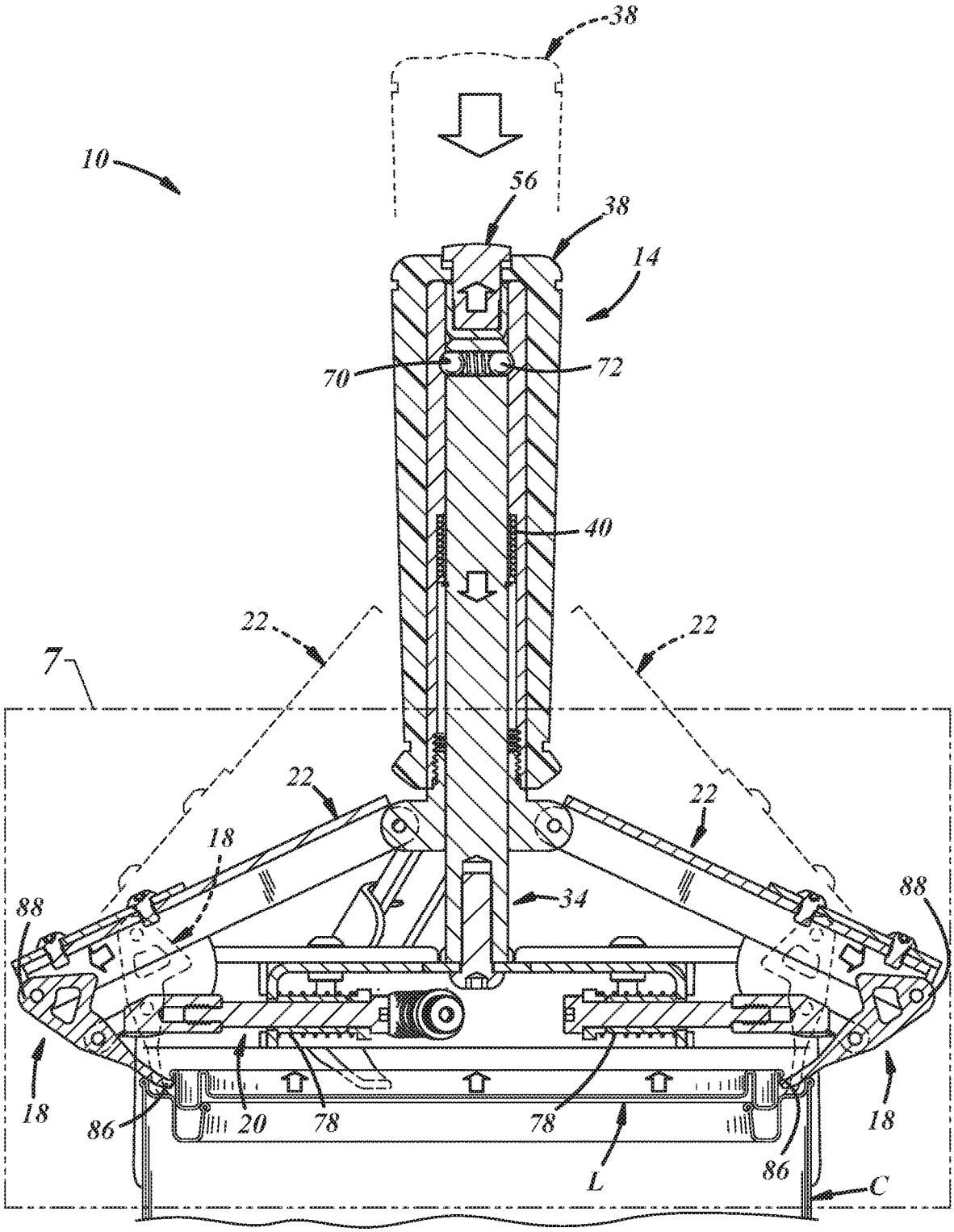
FIG. 6 is a cross-sectional view of the closure remover of FIG. 1, similar to that of FIG. 4, but illustrating the closure remover removing a lid from a container of a package.

With reference to FIG. 6, once the pry fingers 18 are properly located, the actuator 14 is translated toward the frame 12 against the bias force offered by the actuator spring 40. Translation of the actuator 14 toward its fully actuated position articulates the drive links 22 in a radially outward and axially downward direction.

Figure 7:
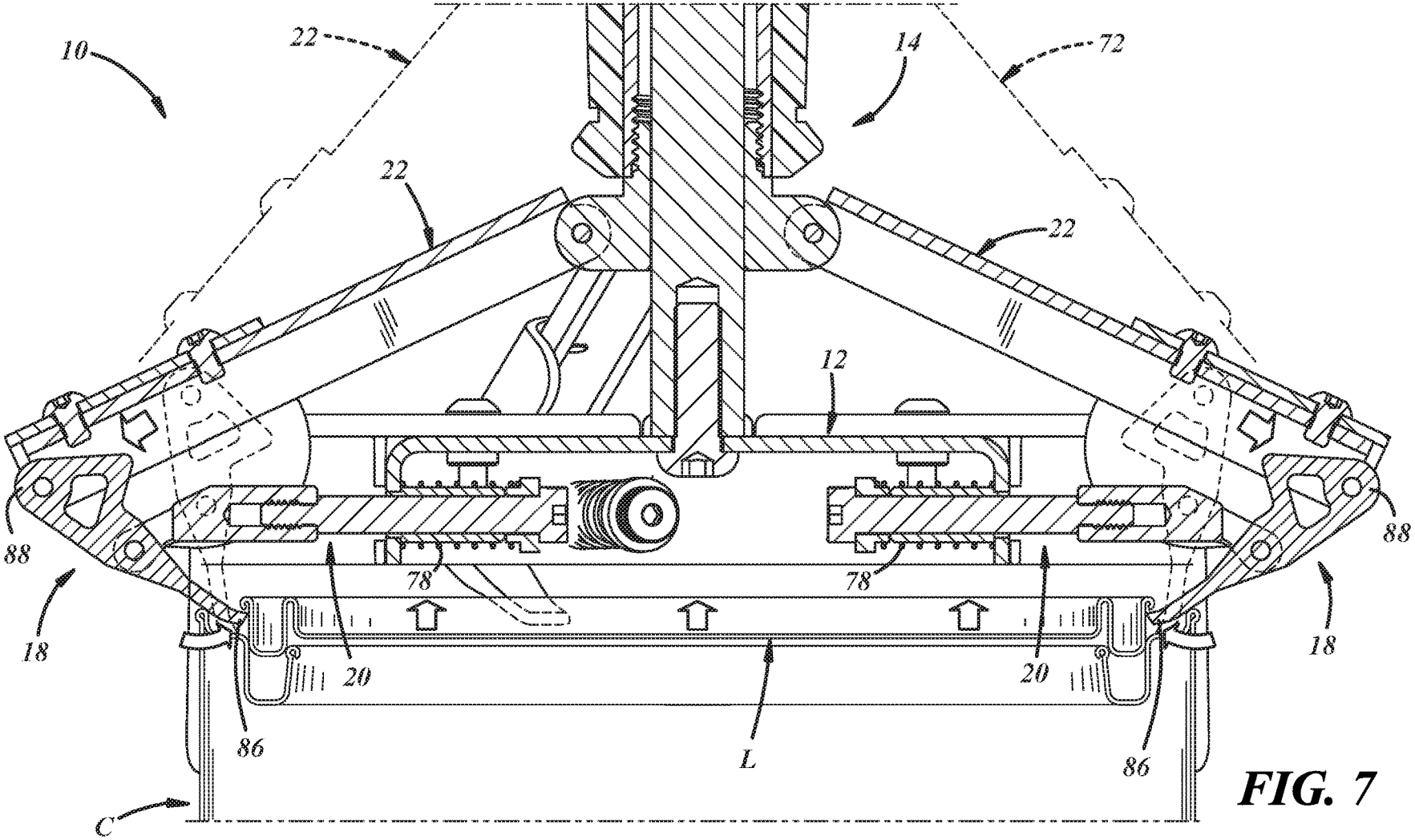
FIG. 7 is an enlarged, fragmentary view of the closure remover of FIG. 1, taken from rectangle 7 of FIG. 6.

With reference to FIG. 7, downward and outward articulating movement of the drive links 22 drives the fixed ends 88 of the pry fingers 18 in a radially outward and axially downward direction, thereby pulling the guide links 20 in directions radially outwardly with respect to the frame 12 and against the bias forces offered by the guide springs 78, and thereby driving the free ends 86 of the pry fingers 18 in axially upward and radially inward directions.

Accordingly, and with reference to FIG. 6, during actuation, the actuator 14 is translatable in a vertically downward direction, the drive links 22 are articulatable in vertically downward and radially outward directions, the guide links 20 are translatable in radially outward directions, and the pry fingers 18 are articulatable in vertically downward and radially inward directions. Therefore, the closure remover 10 can be used to remove a container lid L from a container C, via a plurality of prying forces circumferentially distributed around the lid L, with one downward motion applied by a user. The lid L may become trapped radially between the pry fingers 18 and the yieldable detent 72 engages the fixed detent 70 to retain the closure remover 10 in its fully actuated position. The entire closure remover 10 with the lid L held thereby may be lifted away from the container C, and then a user may press the detent release button 56 to move the handle 38 in a direction relatively away from the guide 34 to disengage the yieldable detent 72 from the fixed detent 70, thereby allowing the compressed spring 40 to unload and thereby act to return the closure remover 10 to its home position and release the lid L.

Figure 8:
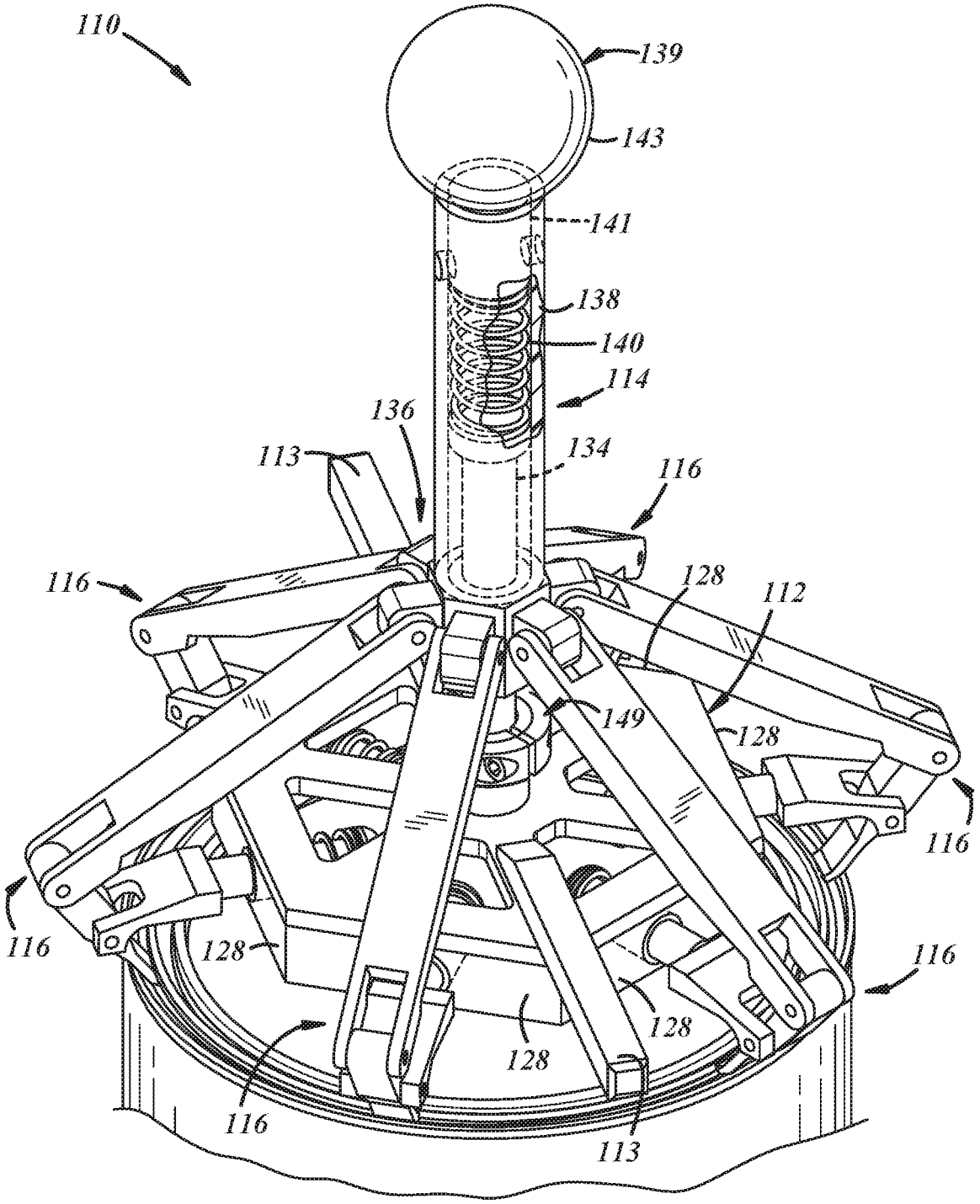
FIG. 8 is a perspective view according to another illustrative embodiment of a closure remover configured to remove a lid from a container of a package, wherein the closure remover is operatively engaged with the package.
Figure 9:
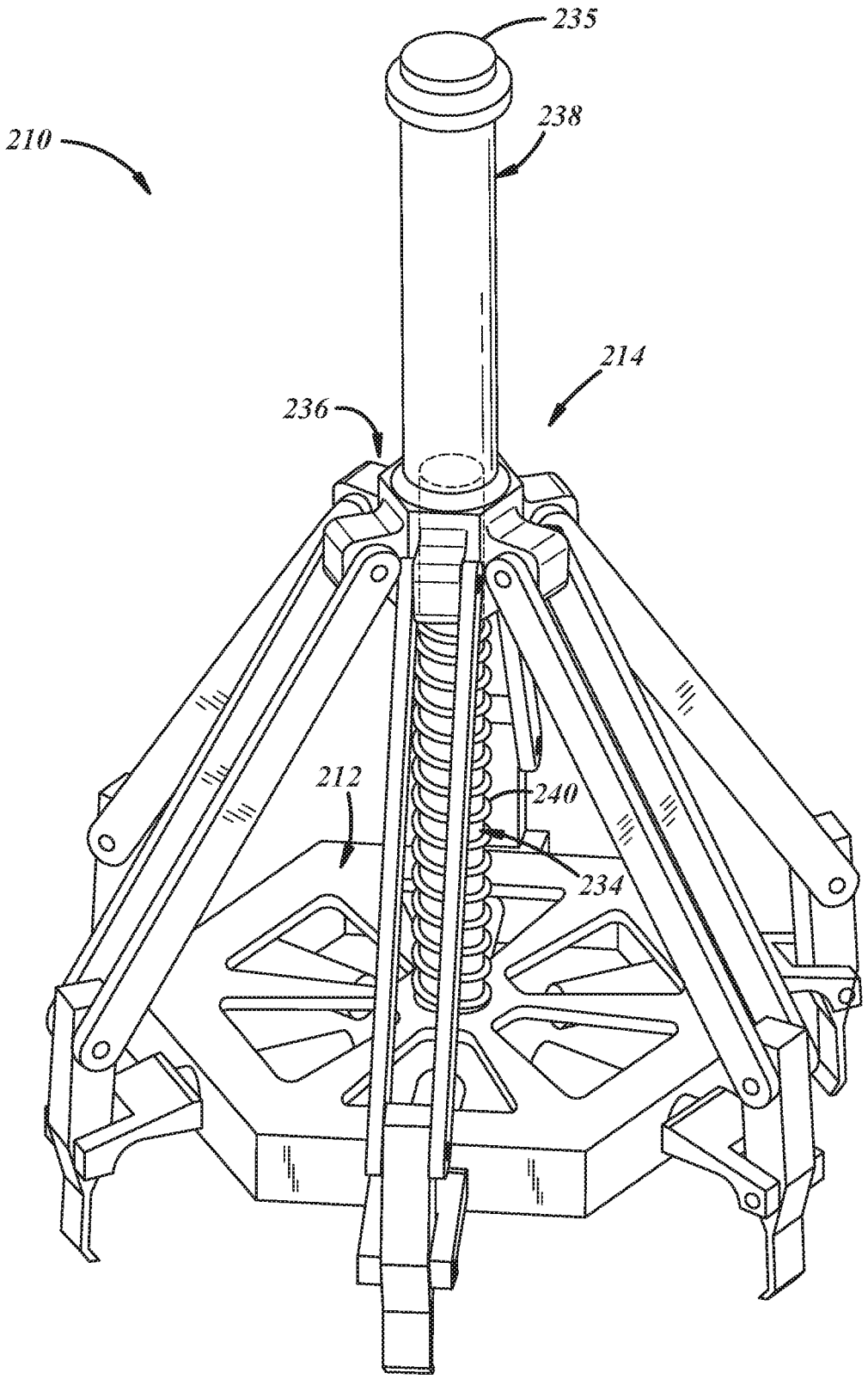
FIG. 9 is a perspective view according to an additional illustrative embodiment of a closure remover configured to remove a lid from a container of a package.

FIGS. 8 and 9 illustrate other illustrative embodiments of closure removers 110, 210. These embodiments are similar in many respects to the illustrated embodiment of FIGS. 1-7 and like numerals between the embodiments generally designate like or corresponding elements throughout the several views of the drawing figures. Accordingly, the descriptions of the embodiments are hereby incorporated into one another, and description of subject matter common to the embodiments generally may not be repeated.

With reference to FIG. 8, the closure remover 110 of this embodiment includes six kinematic links 116 and a base or frame 112 with six facets (five visible). This closure remover 110 also may include a different type of actuator 114 with a handle 138 having a free end with a knob 139, which may include a shaft 141 for insertion into an open end of a hollow shaft of the handle 138 and a spherical grip 143 extending from the shaft 141 for facilitating good gripping by a user. The knob 139 may be pinned to the hollow shaft via one or more press fit pins extending transversely therethrough as shown in the illustrated embodiment, or by direct threading thereto, welding, press fit, and/or any other suitable coupling configuration. The hollow shaft may include a hollow pocket to house an actuator spring 140 that acts between the knob shaft 141 and an enlarged head of a guide 134 extending into the handle 138. Also, an adjustable collar 149 is coupled to the guide 134 between the frame 112 and a link coupling 136 to adjustably limit the stroke of the actuator 114. Also, the frame 112 may include handles 113, for example, as shown diametrically disposed bars carried by the frame 112 and radially extending beyond a radial extent of the rest of the frame 112. The handles 113 may be integral portions of the frame 112, or may be separate components that are fastened, welded, press-fit, or coupled to the frame 112 in any suitable manner. Otherwise, the closure remover 110 is structurally and functionally substantially similar to that of the previous embodiment.

With reference to FIG. 9, the closure remover 210 of this embodiment includes an actuator 214 that is somewhat different from that of the previous embodiments. Here, the actuator 214 includes a guide 234 coupled to a frame 212 and extending axially away therefrom and having an enlarged head 235 at a free end thereof. The actuator 214 also includes a handle 238 translatably carried on the guide 234 between the frame 212 and the enlarged head 235, a link coupling 236 at a lower end of the handle 238, and an actuator spring 240 disposed between the link coupling 236 and the frame 212 to bias the link coupling 236 and handle 238 away from the frame 212. Otherwise, the closure remover 210 is structurally and functionally substantially similar to that of the previous embodiments.

In the illustrated embodiments, the actuators 14, 114, 214 of the closure removers 10, 110, 210 may be actuated manually. But those of ordinary skill in the art will recognize that the closure removers 10, 110, 210 can be adapted for automatic actuation via interfacing with a pneumatic device, hydraulic device, electro-mechanical device, and/or any other device suitable to automatically actuate the closure removers 10, 110, 210. In either case, the closure removers 10, 110, 210 may include axially translatable, spring biased, plunger types of actuators 14, 114, 214.

In general, the components of the closure removers 10, 110, 210 can be manufactured according to techniques known to those skilled in the art, including molding, machining, stamping, and the like. Also, the closure removers 10, 110, 210 can be assembled according to known techniques, manual and/or automatic. Likewise, any suitable materials can be used in making the components, such as metals, composites, polymeric materials, and the like.

In accordance with various embodiments, illustrated herein or otherwise, an illustrative method of opening a package is described below. In a first step, at least three pry fingers are engaged against a lid and a container of the package in at least three locations circumferentially spaced around the package. In a second step, the pry fingers are moved against the container and the lid, to pry the lid away from the container. The first step may include locating free ends of the pry fingers between corresponding portions of the lid and the container, and the second step may include driving fixed ends of the pry fingers so as to pivot the pry fingers about pivot axes between the ends.

The method also may include piloting the closure remover to the package before the pry fingers engage the package. Further, the method may include applying biasing forces on the pry fingers to bias free ends of the pry fingers in a radially outward direction. Also, the pry fingers may be simultaneously actuated, may be articulated, and may be equidistantly circumferentially spaced apart, for example, in a circumferential or circular array. Free ends of the pry fingers may be moved in both radially inwardly and axially upwardly directions.

Also, the method need not include any steps of pressing, grasping, or otherwise engaging a central portion of the lid. Likewise, other than the optional piloting step, the method need not include any steps of pressing, grasping, or otherwise engaging an outer cylindrical surface of the container to effectuate removal of the lid from the container.

As used in this patent application, the terminology "for example," "for instance," "like," "such as," "comprising," "having," "including," and the like, when used with a listing of one or more elements, is open-ended, meaning that the listing does not exclude additional elements. Likewise, when preceding an element, the articles "a," "an," "the," and "said" mean that there are one or more of the elements. Moreover, directional words such as front, rear, top, bottom, upper, lower, radial, circumferential, axial, lateral, longitudinal, vertical, horizontal, transverse, and/or the like are employed by way of example and not limitation. Other terms are to be interpreted and construed in the broadest reasonable manner in accordance with their ordinary and customary meaning in the art, unless the terms are used in a context that requires a different interpretation.

Finally, the present disclosure is not a definitive presentation of an invention claimed in this patent application, but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Therefore, the claimed invention is not limited to the particular examples of illustrative embodiments disclosed herein but, instead, is defined by the accompanying claims.

The invention claimed is:

1. A method of opening a package, comprising:

engaging at least three pry fingers against a lid and a container of a package in at least three locations spaced circumferentially around the package; and moving free ends of the pry fingers directly against the container and the lid, to pry the lid away from the container, by driving fixed ends of the pry fingers so as to pivot the pry fingers about pivot axes between the fixed and free ends.

2. The method of claim 1, wherein the moving step includes simultaneously moving the pry fingers.

3. The method of claim 1, wherein the pry fingers are equidistantly circumferentially spaced apart.

4. The method of claim 1, further comprising applying biasing forces on the pry fingers to bias free ends of the pry fingers in a radially outward direction, and wherein the moving step includes articulating the pry fingers.

5. The method of claim 1, wherein the moving step includes moving the free ends of the pry fingers in both radially inwardly and axially upwardly directions.

6. The method of claim 1, wherein the engaging step includes locating the free ends of the pry fingers in a channel between corresponding portions of the lid and the container wherein the package is a paint package and the container is a paint can.

7. The method of claim 1, wherein at least one of a central portion of the lid or an outer cylindrical surface of the container are not engaged to effectuate removal of the lid from the container.

8. The method of claim 1, wherein the method is carried out using a closure remover to open the package, wherein the closure remover includes:

a frame;

an actuator movable with respect to the frame; and a plurality of kinematic links movably carried between the frame and the actuator and including the pry fingers, which are articulatable.

9. The method of claim 8, wherein the kinematic links include:

a plurality of guide links translatably carried by the frame, wherein the pry fingers are pivotably coupled to the guide links; and a plurality of drive links pivotably coupled to the actuator, wherein the pry fingers are pivotably coupled to the drive links.

10. The method of claim 8, further comprising a guide coupled to and extending axially away from the frame.

11. The method of claim 8, further comprising a releasable detent between the guide and the actuator, and a detent release button to disengage the detent.

12. The method of claim 8, further comprising a spring to bias the actuator in a direction away from the frame.

13. The method of claim 8, further comprising package locators that include skirt portions that terminate in free ends axially beyond the pry fingers.

14. The method of claim 8, having no means to press down on a central portion of the lid and having no means to grasp an outer cylindrical surface of the container.

15. The method of claim 1, wherein the package is a paint package and the container is a paint can.

16. The method of claim 1, wherein the pivot axes are spaced apart.

17. A method of opening a package, comprising:

engaging at least three pry fingers against a lid and a container of a package in at least three locations spaced circumferentially around the package; and moving free ends of the pry fingers against the container and the lid, to pry the lid away from the container, by driving fixed ends of the pry fingers so as to pivot the pry fingers about pivot axes between the fixed and free ends, wherein the method is carried out using a closure remover to open the package, wherein the closure remover includes:

a frame;

a guide coupled to and extending away from the frame along a central longitudinal axis of the closure remover;

an actuator translatable toward and away from the frame along the guide and including a link coupling; and at least three kinematic links movably carried between the frame and the actuator and including:

articulatable drive links pivotably coupled to the link coupling, translatable guide links carried by the frame and biased in an inward direction transverse to the axis, and articulatable pry fingers having free ends, fixed link portions pivotably coupled to the drive links, and intermediate portions disposed between the free ends and the fixed link portions and pivotably coupled to the guide links.

18. The method of claim 17, wherein the actuator also includes a handle translatably carried by the guide for moving the coupling along the guide.

19. The method of claim 17, further comprising a spring to bias the link coupling in a direction away from the frame.

20. The method of claim 19, wherein the guide includes a shaft and the spring includes a compression coil spring circumscribing the shaft.

21. A method of opening a package, comprising:

engaging at least three pry fingers against a lid and a container of a package in at least three locations spaced circumferentially around the package; and moving free ends of the pry fingers directly against the container and the lid, to pry the lid away from the container, by driving fixed ends of the pry fingers so as to pivot the pry fingers about pivot axes between the fixed and free ends;

wherein the method is carried out using a closure remover to open the package, wherein the closure remover includes:

a frame, an actuator movable with respect to the frame, a plurality of kinematic links movably carried between the frame and the actuator and including the pry fingers, which are articulatable, and a guide coupled to and extending axially away from the frame, wherein the actuator is translatably carried by the guide and includes a link coupling to which the drive links are pivotably coupled.

* * * * *